United States Patent [19]

Pogoda

[11] 4,252,048

[45] Feb. 24, 1981

[54] SIMULATED VIBRATING STRING TUNER

[76] Inventor: Gary S. Pogoda, 223 N. Douglas Ave., Margate, N.J. 08402

[21] Appl. No.: 965,083

[22] Filed: Nov. 30, 1978

[51] Int. Cl.[3] ..... G10G 7/02

[52] U.S. Cl. ..... 84/454; 84/464 A; 84/DIG. 18; 324/79 R

[58] Field of Search ..... 84/454, 455, 453, 456, 84/457, 458, DIG. 18, 464 A, 41; 324/79 R, 81

[56] References Cited

U.S. PATENT DOCUMENTS

| | | | |
|---|---|---|---|
| 2,514,315 | 7/1950 | Dickerson | 84/454 |
| 2,779,920 | 1/1957 | Petroff | 84/454 |
| 3,722,353 | 3/1973 | Westhaven | 84/454 |
| 3,861,266 | 1/1975 | Whitaker | 84/454 |
| 3,901,120 | 8/1975 | Youngquist | 84/454 |
| 4,014,242 | 3/1977 | Sanderson | 84/454 |
| 4,041,783 | 8/1977 | Shimauchi | 84/454 |
| 4,061,071 | 12/1977 | Cameron | 84/455 |
| 4,078,469 | 3/1978 | Calvin | 84/454 |

*Primary Examiner*—L. T. Hix
*Assistant Examiner*—S. D. Schreyer
*Attorney, Agent, or Firm*—Duffield & Lehrer

[57] ABSTRACT

A transducer produces an electrical signal representing the frequency of a tone produced by the vibrating string of a musical instrument. Circuit means convert the electrical signal into a visually perceivable form which moves or appears to move in unison with the vibrating string. The signal from a frequency generator representing the desired frequency operates a strobe light source which is operatively associated with the visual vibrating motion display. When the string is in tune with the pre-selected desired frequency from the generator, the vibratory motion appears to stop and the strobe light or vibrating element appears to stand still.

8 Claims, 4 Drawing Figures

SIMULATED VIBRATING STRING TUNER

BACKGROUND OF THE INVENTION

The present invention is directed toward a device for tuning musical instruments and more particularly toward a device which employs a stroboscopic technique for tuning the instrument.

Stroboscopic tuning of musical instruments and particularly vibrating string instruments have been known for some time. Briefly, this is accomplished by shining a light on one of the strings desired to be tuned and strobing the light at a frequency equal to the desired frequency of the string. When the resonating frequency of the plucked string is equal to the frequency of the strobe light, the string appears to an observer to be stationary. When this occurs, the string has been tuned to the stroboscopic frequency. Such techniques and devices for accomplishing the same are described, for example, in U.S. Pat. No. 3,385,153 and U.S. Pat. No. 4,061,071.

There are times, however, when it is difficult or impossible to employ the basic stroboscopic tuning technique described above. For example, not everyone's eyesight is keen enough to see the vibrations of a vibrating string. And in some applications, such as in tuning an upright or spinet piano, the main part of the string, which moves the most during vibration, may be totally inaccessible.

Thus, there has been a need for a tuning device which has the exactness and simplicity of a stroboscopic tuner but which does not suffer from the drawbacks discussed above. Attempts have been made, heretofore, to accomplish this. For example, U.S. Pat. No. 3,861,266 and U.S. Pat. No. 4,014,242 describes systems using a simulated stroboscopic technique with a simulated rotating member. U.S. Pat Nos. 3,901,120 and 4,078,469 simulate a member in repeated unidirectional linear motion. However, none of these systems are believed to be satisfactory since they do not truly simulate the vibrations of a vibrating string. Since the string being tuned is vibrating, a device which simulates the vibrating action of the string is easier to visualize and relate to and, accordingly, would be easier to utilize by one tuning the instrument.

SUMMARY OF THE INVENTION

In order to accomplish the foregoing, a transducer produces an electrical signal representing the frequency of a tune produced by the vibrating string of a musical instrument. Circuit means convert the electrical signal into a visually perceivable form which moves or appears to move in unison with the vibrating string. The signal from a frequency generator representing the desired frequency operates a strobe light source which is operatively associated with the visual vibrating motion display. When the string is in tune with the pre-selected desired frequency from the generator, the vibratory motion appears to stop and the strobe light or vibrating element appears to stand still.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
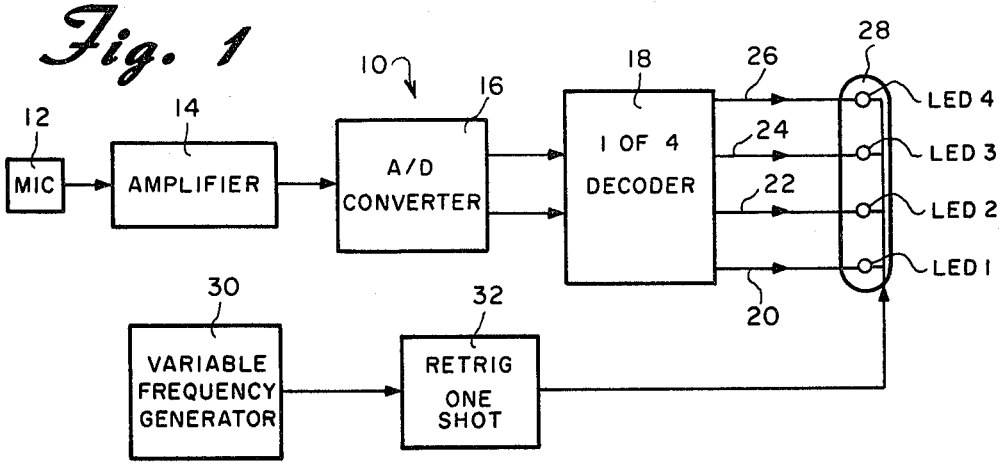
FIG. 1 is a system diagram indicating the major circuits and components of one form of the present invention.

Referring now to the drawings in detail wherein similar reference numerals have been used throughout the various figures to designate similar elements, there is shown in FIG. 1 one form of a simulated vibrating string tuner system constructed in accordance with the principles of the present invention and designated generally as 10.

System 10 is comprised essentially of a microphone or similar transducer 12, the output of which is connected to an amplifier 14. Amplifier 14 preferrably includes standard automatic gain control. The output of amplifier 14 is connected to the input of an analog to digital converter 16 whose output is, in turn, connected to the input of the one of four decoder 18.

Decoder 18 has four outputs 20, 22, 24, and 26. A different one of the outputs 20–26 will have a signal applied thereto in correspondence with the instantaneous voltage of the output of transducer 12. In other words, the output of decoder 18 will track the wave form of the input frequency. Thus, as the wave form passes through zero volts, a signal will be applied to output line 20 of decoder 18. As the voltage of the wave form increases, signals are applied progressively to output lines 22, 24, and 26 and as the signal is applied to the next succeeding output line, it is removed from the preceding one. As the voltage of the wave form decreases from the peak, the signal on output 26 is removed and is reapplied progressively to output lines 24, 22 and 20. As shown in FIG. 1, the output lines 20, 22, 24 and 26 are connected, respectively, to one side of a plurality of light emitting diodes LED 1, LED 2, LED 3, and LED 4 mounted on a lamp panel 28.

System 10 further includes a variable frequency generator 30 which is capable of selectively generating any one of a plurality of pre-determined audio frequency signals. For example, if the system 10 is intended to be used for tuning a guitar, variable frequency generator 30 would be capable of generating six different audio frequency signals corresponding to the resident frequency of the strings and E,A,D,G,B and E of a guitar. The output of variable frequency generator 30 is connected to the input of a retriggerable one shot 32 which in turn has its output connected to the other side of each of the light emitting diodes 1–4. Retriggerable one shot 32 generates a pulse every time the signal from the variable frequency generator 30 transverses from the low to the high state. Thus, the output of retriggerable one shot 32 will be a series of pulses corresponding to the selected frequency of variable frequency generator 30.

The simulated vibrating string tuner 10 described above functions in the following manner. Microphone 12 is placed on or near a guitar or other instrument and the proper frequency is selected on variable frequency generator 30 corresponding to the string desired to be tuned. The signal from microphone 12 is amplified by amplifier 14 and is sent to the analog to digital converter 16 which provides a two bit binary output. This binary output is applied to the one of four decoder 18 thereby providing signals to the lamp panel 28 through output lines 20, 22, 24 and 26 in the manner described hereinabove. Thus, the signals applied to lines 20–26 will track the wave form of the signal from microphone 12 thereby somewhat resembling the vibrating string itself.

Simultaneously, the signal from the variable frequency generator 30 is converted by the retriggerable one shot 32 into a series of pulses corresponding to the desired frequency. These pulses are applied to the collected side of the light emitting diodes LED 1, LED 2, LED 3 and LED 4 thereby enabling each of the diodes simultaneously at a rate again corresponding to the desired frequency selected on variable frequency generator 30. At this point, one observing the lamp panel 28 would observe the light emitting diodes 1–4 blinking on and off in an up and down vibratory pattern very much resembling the appearance of a moving string with a strobe light shined thereon such as is used in prior art strobe tuning devices. As the string is manually tuned, the pattern of the lights will change in the same manner and again resembling the appearance of a string with a stroboscopic light shining thereon. Eventually, as the resonant frequency of the string is brought into coincidence with the pre-selected desired frequency from variable frequency generator 30 (or an integral thereof), one of the light emitting diodes 1–4 on lamp panel 28 will appear to be constantly on.

Figure 2:
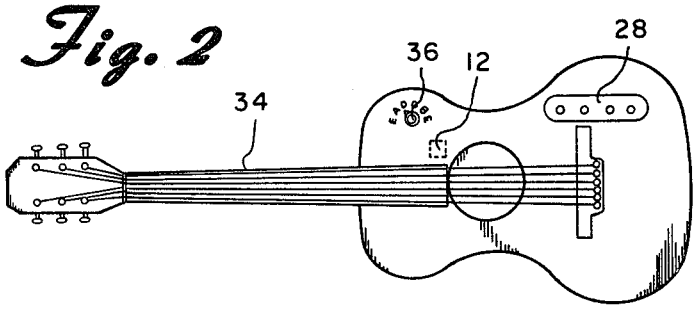
FIG. 2 is a perspective view of a guitar showing the invention of FIG. 1 mounted therein.

FIG. 2 shows the ease in which the system 10 described above can be built into a guitar or similar string instrument 34. It can be seen that the microphone 12 can be mounted within the housing as can the remaining electronic components including a battery source, if desired. A switch 36 accessible from the outside of the guitar 34 may be used to select the desired variable frequency from the variable frequency generator 30. Lamp panel 28 may also be mounted on the guitar so as to be visible from the outside thereof and should be located so as to be easily observable while the guitar is being tuned.

Figure 3:
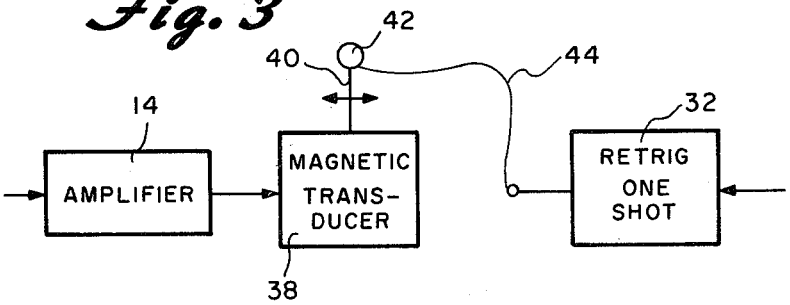
FIG. 3 is a system diagram of a second embodiment of the invention.
Figure 4:
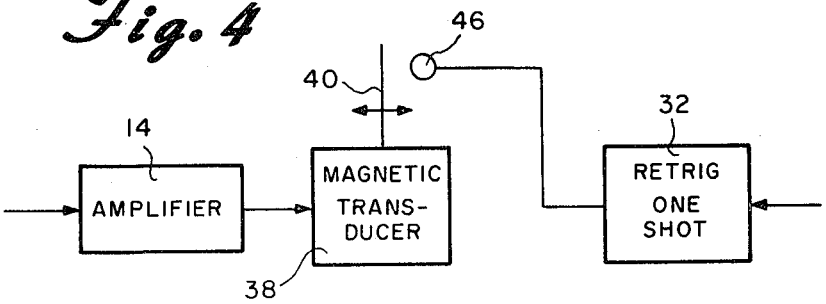
FIG. 4 is a system diagram of another embodiment of the invention.

FIGS. 3 and 4 show two modified forms of the simulated vibrating string tuner 10. In each of these embodiments, the output from amplifier 14 is applied to an electrical-to-mechanical transducer such as magnetic transducer 38. Armature 40 of magnetic transducer 38 is thereby caused to vibrate back and forth in the directions of the arrows at the same frequency as the string or tune picked up by microphone 12.

The output of the retriggerable one shot 32 is connected to a light emitting diode 42 which is mounted on the armature 40 of magnetic transducer 38. The connection between the output of the retriggerable one shot 32 and the light emitting diode 42 is by way of a flexible conductor 44 so as not to interfere with the movement of the diode 42. Thus, it should be readily apparent that the diode 42 will move back and forth at a frequency equal to the frequency of the vibrating string and the visual effect will be substantially the same as the appearance of a strobe light being shined on a vibrating string. When the string is in tune, the light emitting diode 42 will appear to be standing still.

The modifications shown in FIG. 4 is substantially identical to that shown in FIG. 3 except that light emitting diode 46 is not mounted on the armature 40 of the magnetic transducer 38. Rather, the light emitting diode 46, merely shines on the armature 40. Again, the effect of the light emitting diode 46 shining on the moving armature 40 will be substantially the same as a strobe light shining on a vibrating string in accordance with known stroboscopic tuning techniques. When the string is in tune, the armature 40 will appear to be standing still.

The present invention has been described with specific reference to the tuning of guitars. It should be readily apparent, however, that the invention is not limited thereto. The same could be used for tuning any stringed instrument and, in fact, substantially any instrument which can be tuned whether or not it is a stringed instrument. In addition, the invention could be used as a teaching device. For example, the system could be used to aid a trombone player in finding the precise slide position for a given note.

The present invention may be embodied in other specific forms without departing from the spirit or essential attributes thereof and, accordingly, reference should be made to the appended claims, rather than to the foregoing specification as indicating the scope of the invention.

I claim:

1. In a device for tuning musical instruments comprising:

transducer means for producing an electrical signal representing the frequency of a tone produced by a musical instrument;

generator means for generating a control frequency electrical signal, and means converting said electrical signal and said control signal into a form which can manifest itself visually so as to simulate the up and down pattern observed of a stroboscopically illuminated vibrating element which is out of tune and the stationary pattern observed of a stroboscopically illuminated vibrating element which is in tune.

2. The device as claimed in claim 1 wherein said converting means includes a plurality of lights and means sequentially applying an electrical signal to each of said plurality of lights during each cycle comprising the frequency of said tone.

3. The device as claimed in claim 2 wherein said control frequency electrical signal simultaneously enables each of said plurality of lights at a rate equal to said control frequency.

4. The device as claimed in claim 1 wherein all of the operative components thereof are mounted within said musical instrument.

5. The device as claimed in claim 1 wherein said converting means includes a plurality of lights which sequentially turn on and off so as to display an up and down vibrating motion whenever said musical instrument is out of tune and wherein only one of said lights is on when said musical instrument is in tune.

6. In a device for tuning musical instruments comprising:

transducer means for producing an electrical signal representing the frequency of a tone produced by a musical instrument;

generator means for generating a control frequency electrical signal, and means including an electrical-to-mechanical transducer for converting said electrical signal and said control signal into a form which can manifest itself visually so as to simulate the pattern observed of a stroboscopically illuminated vibrating element.

7. The device as claimed in claim 6 further including a strobe light source carried by said electrical-to-mechanical transducer so as to move therewith.

8. The device as claimed in claim 6 further including a strobe light source adapted to illuminate said electrical-to-mechanical transducer.

* * * * *